United States Patent [19]

Takagi et al.

[11] 4,308,444

[45] Dec. 29, 1981

[54] MICROWAVE OVEN WITH A CAPABILITY OF FUNCTIONING AS AN ELECTRIC HEATING OVEN

[75] Inventors: Yutaka Takagi, Sakai; Munemitsu Toyoda, Osaka, both of Japan

[73] Assignee: Sharp Kabushiki Kaisha, Osaka, Japan

[21] Appl. No.: 52,752

[22] Filed: Jun. 28, 1979

Related U.S. Application Data

[63] Continuation of Ser. No. 776,358, Mar. 10, 1977, abandoned.

[30] Foreign Application Priority Data

| | | | |
|---|---|---|---|
| Mar. 11, 1976 | [JP] | Japan | 51-26705 |
| Mar. 29, 1976 | [JP] | Japan | 51-34749 |
| Mar. 31, 1976 | [JP] | Japan | 51-39990[U] |
| Apr. 1, 1976 | [JP] | Japan | 51-40504[U] |
| Apr. 9, 1976 | [JP] | Japan | 51-44481[U] |

[51] Int. Cl.[3] ..... H05B 6/64

[52] U.S. Cl. ..... 219/10.55 B; 219/10.55 R; 219/400; 126/21 R

[58] Field of Search ..... 219/10.55 R, 10.55 B, 219/10.55 F, 10.55 A, 10.55 D, 10.55 E, 10.55 M, 400, 411; 126/21 A, 21 R, 15 A, 15 R

[56] References Cited

U.S. PATENT DOCUMENTS

| | | | |
|---|---|---|---|
| 1,169,694 | 11/1916 | Swisher | 219/400 X |
| 2,860,026 | 11/1958 | Long | 219/10.55 B |
| 2,920,174 | 1/1960 | Haagensen | 219/10.55 F |
| 3,006,333 | 10/1961 | Niemann | 126/21 A |
| 3,308,261 | 3/1967 | Velander | 219/10.55 F |
| 3,364,912 | 1/1968 | Dills et al. | 126/21 A |
| 3,459,921 | 8/1969 | Fussell et al. | 219/10.55 D |
| 3,548,152 | 12/1970 | Klepzig | 219/413 X |
| 3,878,350 | 4/1975 | Takagi | 219/10.55 E |
| 3,884,213 | 5/1975 | Smith | 219/400 X |
| 4,028,520 | 6/1977 | Torrey | 219/10.55 B |

FOREIGN PATENT DOCUMENTS

| | | | |
|---|---|---|---|
| 49-34440 | 3/1974 | Japan | 219/10.55 R |

*Primary Examiner*—Gene Z. Rubinson
*Assistant Examiner*—Philip H. Leung
*Attorney, Agent, or Firm*—Birch, Stewart, Kolasch & Birch

[57] ABSTRACT

A microwave oven with a capability of functioning as an electric heating oven comprises an oven cavity surrounded by a heat insulating wall or an athermanous wall. A forced air flow creating means includes a damper means for creating the air flow within the oven cavity when the microwave heating operation is performed, and for creating the air flow around the oven cavity wall when the electric heating operation is performed.

10 Claims, 10 Drawing Figures

MICROWAVE OVEN WITH A CAPABILITY OF FUNCTIONING AS AN ELECTRIC HEATING OVEN

This application is a continuation of copending application Ser. No. 776,358, filed on Mar. 10, 1977, now abandoned.

BACKGROUND AND SUMMARY OF THE INVENTION

The present invention relates to a microwave oven which further functions as an electric heating oven through the use of a heater arrangement disposed within an oven cavity.

When electric heating cooking is desired to be performed by a microwave oven through the use of a heater arrangement disposed within an oven cavity, it is of great importance to maintain the interior of the oven cavity at a high temperature and to protect assemblies disposed around the oven cavity from the high temperature.

An air flow should be introduced into the oven cavity during microwave heating cooking in order to discharge vapor or smoke from the oven cavity. This smoke is unavoidably produced during the cook operation and disturbs effective microwave heating. However, the air flow should not be introduced into the oven cavity during the electric heating cooking in order to maintain the interior of the oven cavity at a high temperature.

Accordingly, an object of the present invention is to provide a microwave oven which further functions as an electric heating oven.

Another object of the present invention is to maintain the interior of an oven cavity at a high temperature when cooking by use of electric heating is performed.

Still another object of the present invention is to maintain the exterior of the oven cavity at a low temperature even when cooking by use of electric heating cooking is performed.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a heat insulating wall or an athermanous wall made of, for example, glass wool, is provided in such a manner as to surround an oven cavity. A forced air flow creating means including a blower is associated with a damper means so that a magnetron is cooled and the air flow is introduced into the interior of the oven cavity during microwave heating cooking, whereas the exterior of the oven cavity is cooled and the air flow is not introduced into the interior of the oven cavity during electric heating cooking.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
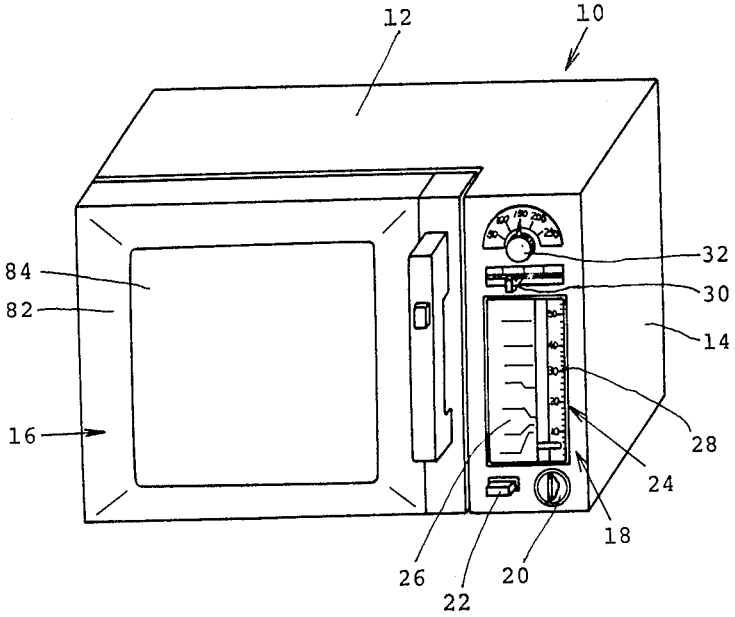
FIG. 1 is a perspective view of an embodiment of a microwave/electric heating oven of the present invention.

FIG. 1 shows an embodiment of a microwave/electric heating oven of the present invention. The microwave/electric heating oven 10 includes an upper casing 12, a side casing 14, an oven door 16 and a control panel 18. The control panel 18 includes a timer setting knob 20, a cook switch 22, an indication panel 24 including a menu drum 26 and a timer scale 28, a selection lever 30, and a temperature setting knob 32.

The selection lever 30 is used to select operation modes of the microwave/electric heating oven. That is, the microwave/electric heating oven functions as an electric heating oven or a microwave heating oven in accordance with the location of the selection lever 30. The temperature setting knob 32 is used to set an oven temperature at a desired value when the microwave/electric heating oven operates in the electric heating mode.

Figure 2:
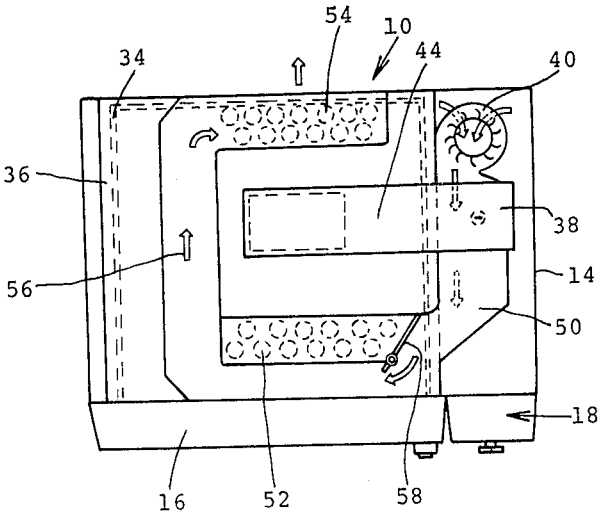
FIG. 2 is a plan view of the microwave/electric heating oven of FIG. 1, wherein an upper casing of the microwave/electric heating oven is removed.
Figure 3:
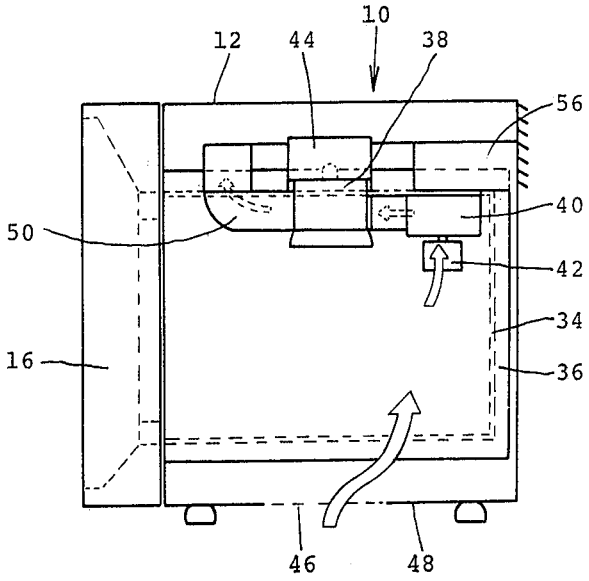
FIG. 3 is a side view of the microwave/electric heating oven of FIG. 1, wherein a side casing of the microwave/electric heating oven is removed.

FIG. 2 is a plan view of the microwave/electric heating oven 10, wherein the upper casing 12 is removed, and FIG. 3 is a side view of the microwave/electric heating oven 10, wherein the side casing 14 is removed. Like elements corresponding to those of FIG. 1 are indicated by like numerals.

An oven wall 34 made of a metal plate determines an oven cavity, and a heat insulating wall or an athermanous wall 36 made of, for example, glass wool, asbestos or calcium silicate is provided in such a manner as to surround the oven wall 34, whereby the interior of the oven wall 34 is maintained at a high temperature when cooking by use of the electric heating is performed. In addition, the microwave/electric heating oven includes a magnetron 38 for microwave cooking purposes, a blower fan assembly 40 associated with a blower motor 42, and a waveguide 44 for conducting microwave energy into the oven cavity. These elements are secured on the athermanous wall 36.

The blower fan assembly 40 functions to introduce ambient air, through openings 46 formed in a bottom casing 48, into the microwave/electric heating oven 10 in order to cool the magnetron 38 and to create a forced air flow within the oven cavity. The ambient air introduced through the openings 46, first, functions to cool the exterior of the athermanous wall 36, and then the forced air flow is generated by the blower fan assembly 40 in order to cool the magnetron 38. The air flow passing through the magetron 38 is conducted by an air duct 50 and introduced into the oven cavity through openings 52 during the microwave heating mode. Subsequently, this introduced air flow is discharged through openings 54. During the electric heating mode, the air flow is not introduced into the oven cavity, but is discharged through an air discharging duct 56.

The above-mentioned selection of the air flow is performed by a damper means 58. FIG. 2 shows a condition when the microwave/electric heating oven 10 is placed in the electric heating mode, wherein the forced air flow is not introduced into the oven cavity in order to maintain the interior of the oven cavity at a high temperature. In the electric heating mode, the exterior of the oven cavity is cooled by the air flow from the opening 46 toward the blower fan assembly 40.

Figure 6:
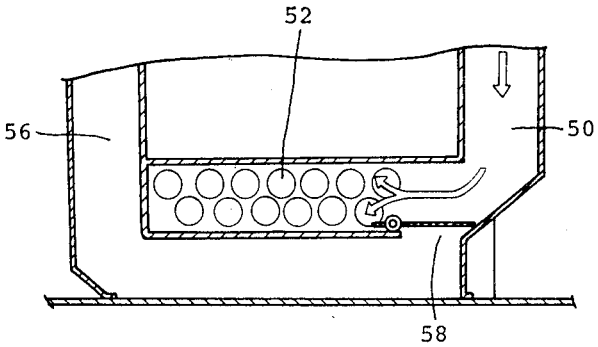
FIG. 6 is a sectional view showing a damper means included within the microwave/electric heating oven of FIG. 1.

FIG. 6 shows a condition when the microwave/electric heating oven 10 is placed in the microwave heating mode, wherein the forced air flow is introduced into the oven cavity in order to enhance microwave heating efficiency.

Figure 7:
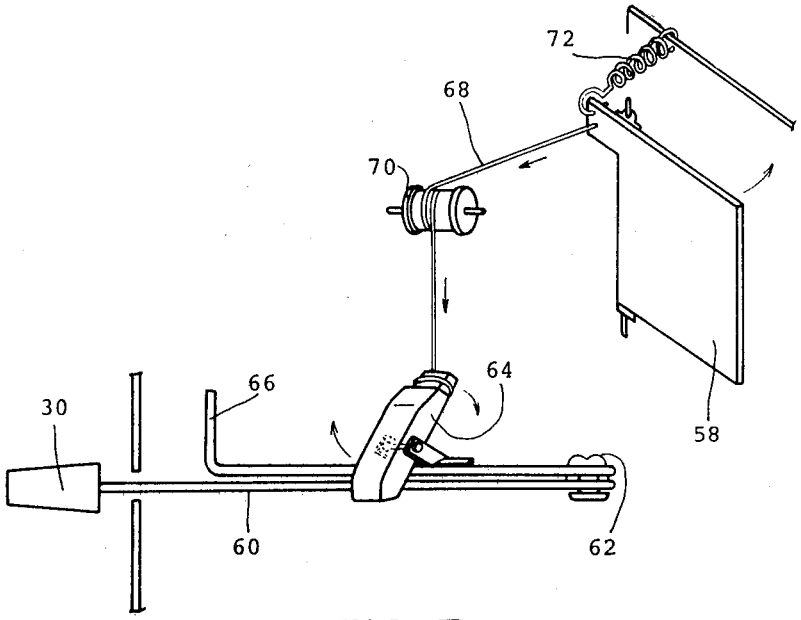
FIG. 7 is a perspective view of a driving means for rotating the damper means of FIG. 6.

FIG. 7 shows a mechanism for rotating the damper means 58. The damper means 58 is associated with the selection lever 30 fixed to a movable rod 60 which is secured rotatably around a pin 62. When the selection lever 30 is positioned at the electric heating mode, a rotation lever 64 supported by a stationary plate 66 is rotated by the movable rod 60, whereby the damper means 58 is rotated through a wire 68 and a pulley 70. When the selection lever 30 is positioned at the microwave heating mode, the damper means 58 is rotated by a spring means 72 in order to introduce the air flow into the oven cavity.

Figure 4:
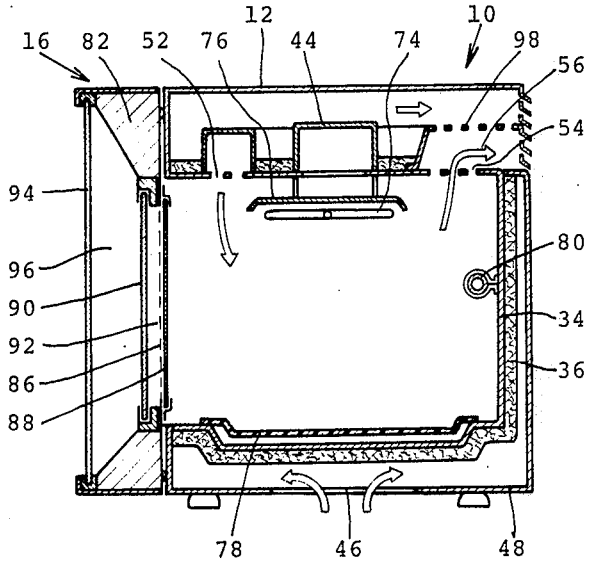
FIG. 4 is a sectional side view of the microwave/electric heating oven of FIG. 1.

FIG. 4 shows the interior of the oven cavity. Like elements corresponding to those of FIGS. 1, 2 and 3 are indicated by like numerals. A heater arrangement including a sheath heater 74 and a reflection plate 76 is disposed in the upper portion of the oven cavity. A tray 78 is disposed in the bottom of the oven cavity for supporting foodstuffs to be cooked. A temperature sensor 80 is secured on the oven wall 34 in order to maintain the interior of the oven cavity at a desired temperature determined by the temperature setting knob 32 during the electric heating mode.

The oven door 16 comprises a door frame 82 surrounding a window portion 84 (see FIG. 1). The window portion 84 contains a metal plate 86 having a plurality of openings formed therein as is well known in the art. A transparent glass plate 88 is disposed along the inside surface of the metal plate 86. An intermediate glass plate 90 made of glass having a low reflection factor is disposed at the outside of the metal plate 86 in such a manner as to form a clearance 92 between the two glass plates 88 and 90. Another transparent glass plate 94 determines the surface of the oven door 16, whereby another clearance 96 is formed between the two glass plates 90 and 94.

The two clearances 92 and 96 function to prevent leakage of heat energy during the electric heating cooking. The operator can observe the cooking condition through the window portion 84 since the intermediate glass plate 90 has a low reflection factor against light.

A partition wall 98 which may include a plurality of holes formed therein is provided at the outlet section of the air discharging duct 56. The partition wall 98 functions to reduce a backward flow of the forced air flow toward the oven cavity, and functions to accelerate the discharge of vapor or smoke from the oven cavity during the electric heating cooking.

Figure 5:
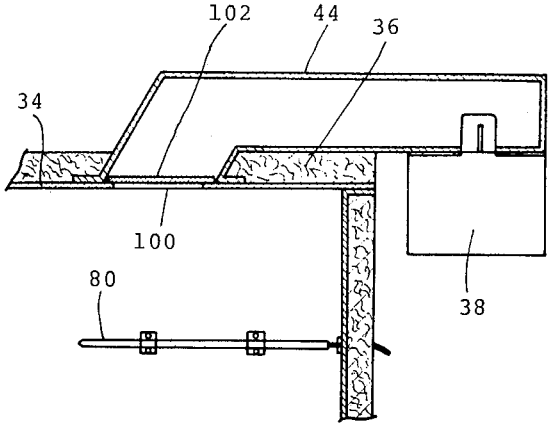
FIG. 5 is a sectional view showing a waveguide included within the microwave/electric heating oven of FIG. 1.

FIG. 5 shows a construction of the waveguide 44. Like elements corresponding to those of FIGS. 2, 3 and 4 are indicated by like numerals. As already discussed, the waveguide 44 is secured on the athermanous wall 36 except its opening 100 at which a heat insulating plate 102 is provided. The heat insulating plate 102 is constructed of a low dielectric loss made of, for example, crystalline glass or ceramics.

Figure 8:
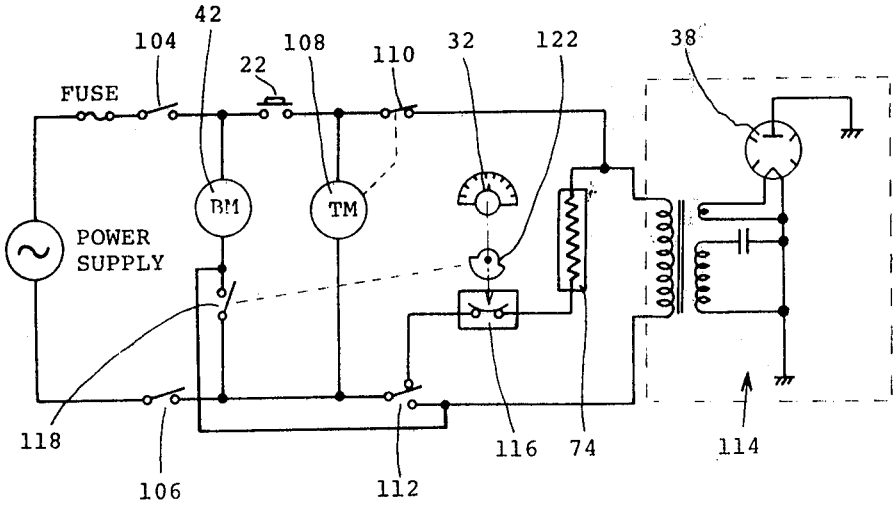
FIG. 8 is a circuit diagram of an embodiment of a control circuit employed within the microwave/electric heating oven of FIG. 1.

FIG. 8 shows a control circuit of the microwave/electric heating oven of FIG. 1. Like elements corresponding to those of FIGS. 1 through 7 are indicated by like numerals.

Interlock switches 104 and 106 are associated with the opening and closing of the oven door 16. A timer motor 108 is associated with the timer setting knob 20 and functions to close a timer contact 110 during a time period determined by the timer setting knob 20. A selection switch 112 is associated with the selection lever 30 in such a manner as to energize a microwave generating circuit 114 including the magnetron 38 when the selection lever 30 is positioned at the microwave cooking mode. In addition, the selection switch 112 energizes the sheath heater 74 when the selection lever 30 is positioned at the electric heating cooking mode.

The energization of the sheath heater 74 is controlled by a liquid expansion thermostat 116 connected to the temperature sensor 80 (see FIG. 5) in such a manner as to maintain the interior of the oven cavity at a desired temperature selected by the temperature setting knob 32. When the selection switch 112 is placed in the microwave cooking mode, the blower motor 42 is always energized. When the selection switch 112 is placed in the electric heating cooking mode, the blower motor 42 is energized only when a control switch 118 is closed.

Figure 9:
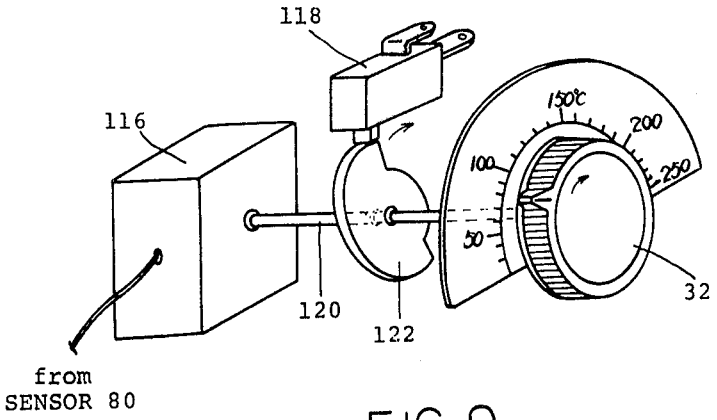
FIG. 9 is a perspective view of a temperature control system employed within the microwave/electric heating oven of FIG. 1.

FIG. 9 shows the temperature control system and the control switch 118 associated with the temperature setting knob 32. The temperature setting knob 32 is associated with the liquid expansion thermostat 116 via a rotatable rod 120. A cam plate 122 is fixed to the rotatable rod 120 so that the cam plate 122 rotates in unison with the rotation of the temperature setting knob 32. When the temperature is set above 80° C., the control switch 118 is closed by the cam plate 122 and, therefore, the blower motor 42 is energized during cooking by use of electric heating in order to cool the exterior of the oven cavity. When the temperature is set below 80° C., the control switch 118 is open and, therefore, the blower motor 42 is not energized.

Figure 10:
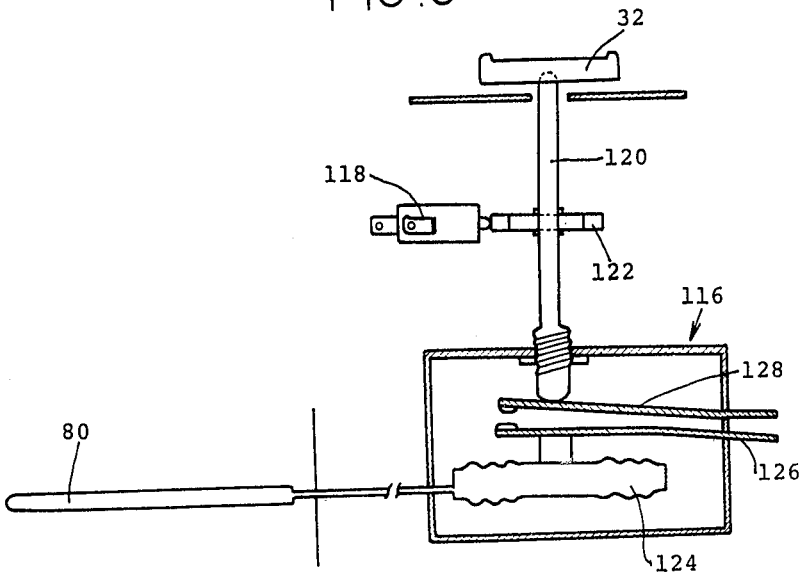
FIG. 10 is a sectional view of the temperature control system of FIG. 9.

FIG. 10 shows a construction of the liquid expansion thermostat 116. The liquid expansion thermostat 116 comprises a section 124 of which the volume varies in a fashion depending on the temperature detected by the sensor 80. Further, a first contact plate 126 is associated with the section 124, and a second contact plate 128 is associated with the temperature setting knob 32 via the rotatable rod 120. The first and second contact plates 126 and 128 are associated with each other in such a manner as to energize the sheath heater 74 when the two contact plates 126 and 128 are separated from each other.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A combined microwave/electric heating oven comprising:

an oven wall defining an oven cavity;

an oven door being operatively connected for providing a closure for said oven cavity;

a heat insulating wall surrounding the oven wall for preventing the leakage of heat energy therethrough;

an outer surface of said oven cavity and an outer housing of said combined microwave/electric heating oven defining therebetween an air cavity which surrounds said oven cavity;

said air cavity being in communication with a fan means for circulating ambient air therethrough;

a microwave generating means disposed adjacent to the oven cavity;

a waveguide means for introducing microwave energy generated from the microwave generating means into the oven cavity;

a heater means disposed within the oven cavity for cooking by means of electric heating and being capable to heat said oven cavity up to an elevated, high temperature;

a selection means for selectively energizing the microwave generating means or the heater means;

a damper means operable by said selection means to direct ambient air circulated by said fan means into said oven cavity only when said selection means is energizing the microwave generating means and being closed to circulate ambient air through said air cavity, which surrounds said oven cavity, to cool an outer surface of said oven cavity and said microwave generating means when said selection means is energizing the heater means;

a heat insulating member disposed adjacent to said oven wall for preventing the leakage of heat energy therethrough and to protect said microwave generating means when said heater means is energized to cook by means of electric heating;

said air cavity being in communication with an inlet opening disposed downstream of said fan means wherein ambient air is drawn into said air cavity by said fan means to first cool the exterior surface of said heat insulating member;

said damper means being disposed within a passageway in communication with said air cavity to selectively direct said ambient air into said oven cavity when said selection means is energizing the microwave generating means and said damper means being closed to circulate said ambient air through said air cavity when said selection means is energizing said heater means; and a discharge air duct being disposed upstream of said damper means, said discharge air duct being closed by said damper means when said selection means is energizing the microwave generating means and being open to circulate said ambient air through said air cavity when said selection means is energizing said heater means;

said discharge air duct being in communication with an outlet opening in said outer housing, said oven cavity including a discharge opening being in communication with said outlet opening, and a partition wall disposed adjacent to said outlet opening for separating said discharge air duct and said discharge opening from each other, said partition wall including a plurality of apertures adapted to reduce a backward flow of said circulated ambient air towards said oven cavity.

2. The microwave/electric heating oven of claim 1, wherein the waveguide means is secured on the heat insulating wall.

3. A combined microwave/electric heating oven according to claim 1, wherein said inlet opening is disposed in a lower base portion of said outer housing.

4. A combined microwave/electric heating oven according to claim 1, said discharge opening of said oven cavity being adapted to permit circulation and discharge of said ambient air within said oven cavity when said selection means is energizing the microwave generating means and being adapted to permit the discharge of smoke or vapor from the oven cavity when said selection means is energizing said heater means.

5. A combined microwave/electric heating oven according to claim 1, wherein said microwave generating means is disposed within said air cavity between said fan means and said damper means so that said circulated ambient air cools said microwave generating means when the selection means energizes either the microwave generating means or the heater means.

6. A combination range comprising:

a housing for said combination range;

an oven wall defining an oven cavity;

said housing and said oven wall defining an air space therebetween which surrounds said oven cavity;

an oven door operatively connected to said housing for providing a closure for said oven cavity;

a microwave generating means provided for cooking purposes when operating in a microwave mode, said microwave generating means being disposed in said air space;

a secondary heat source means disposed within the oven cavity for cooking in a secondary cooking mode other than the microwave cooking mode and being capable to heat said oven cavity up to an elevated, high temperature;

fan means for providing a forced air flow of ambient air within the oven cavity and said air space;

selection means for selectively energizing the microwave generating means or the secondary heat source;

damper means for precluding the introduction of said forced air flow within the oven cavity in the secondary cooking mode and allowing the flow of said forced air flow in said air space, which surrounds said oven cavity, in the secondary cooking mode for cooling at least said microwave generating means;

a heat insulating member disposed adjacent to said oven wall for preventing the leakage of heat energy therethrough and to protect said microwave generating means when said secondary heat source is energized;

said air space being in communication with an inlet opening disposed downstream of said fan means wherein ambient air is drawn into said air space by said fan means to first cool the exterior surface of said heat insulating member;

said damper means being disposed within a passageway in communication with said air space to selectively direct said ambient air into said oven cavity when said combination range is operating in said microwave mode and said damper means being closed to circulate said ambient air through said air space when said combination range is operating in said secondary cooking mode; and a discharge air duct being disposed upstream of said damper means, said discharge air duct being closed by said damper means when said combination range is operating in said microwave mode and being open to circulate said ambient air through said air cavity when said combination range is operating in said secondary cooking mode;

said discharge air duct being in communication with an outlet opening in said outer housing, said oven cavity including a discharge opening being in communication with said outlet opening, and a partition wall disposed adjacent to said outlet opening for separating said discharge air duct and said discharge opening from each other, said partition wall includes a plurality of apertures adapted to reduce a backward flow of said circulated ambient air towards said oven cavity.

7. A combination range of claim 6, wherein a temperature sensor is secured on the oven wall to detect the oven temperature in the electric heating mode.

8. A combination range according to claim 6, wherein said inlet opening is disposed in a lower base portion of said outer housing.

9. A combination range according to claim 6, said discharge opening of said oven cavity being adapted to permit circulation and discharge of said ambient air within said oven cavity when said combination range is operating in said microwave mode and being adapted to permit the discharge of smoke or vapor from the oven cavity when said combination range is operating in said secondary cooking mode.

10. A combination range according to claim 6, wherein said microwave generating means is disposed within said air cavity between said fan means and said damper means so that said circulated ambient air cools said microwave generating means when said combination range is operating in either said microwave mode or said secondary cooking mode.

* * * * *